US011570532B2

(12) United States Patent
Lamberg et al.

(10) Patent No.: US 11,570,532 B2
(45) Date of Patent: Jan. 31, 2023

(54) ELECTRONIC DEVICE WITH LOUDSPEAKER MODULE

(71) Applicant: AAC Microtech (Changzhou) Co., Ltd., Changzhou (CN)

(72) Inventors: Timo Lamberg, Tampere (FI); Juha Backman, Espoo (FI)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 275 days.

(21) Appl. No.: 17/131,770

(22) Filed: Dec. 23, 2020

(65) Prior Publication Data

US 2022/0201376 A1 Jun. 23, 2022

(51) Int. Cl.
*H04R 1/02* (2006.01)
*H04R 1/28* (2006.01)
*H04R 9/06* (2006.01)

(52) U.S. Cl.
CPC ..... *H04R 1/021* (2013.01); *H04R 1/283* (2013.01); *H04R 9/06* (2013.01); *H04R 2499/11* (2013.01)

(58) Field of Classification Search
CPC ..... H04R 1/021; H04R 1/283; H04R 9/06; H04R 2499/11; H04R 1/2842; H04R 1/2834
See application file for complete search history.

(56) References Cited

U.S. PATENT DOCUMENTS

2018/0007465 A1* 1/2018 Liu ..... H04R 1/2865
2018/0310082 A1* 10/2018 Amae ..... B29C 45/1671
2021/0029467 A1* 1/2021 Huang ..... H04R 9/02
2021/0037312 A1* 2/2021 Cho ..... H04M 1/035

* cited by examiner

*Primary Examiner* — Tuan D Nguyen
(74) *Attorney, Agent, or Firm* — W&G Law Group

(57) ABSTRACT

An electronic device includes an enclosure defining a chamber and a first output port communicating the chamber with outside of the enclosure; a loudspeaker module disposed within the chamber. The loudspeaker module includes a first front cavity in communication with the first output port, a second front cavity acoustically connected with an inside space of the enclosure, a rear cavity, a transducer disposed between the first front cavity and the rear cavity, and a first passive radiator disposed between the second front cavity and the rear cavity. The passive radiator is capable of radiating low-frequency sound to the inside space of the enclosure via the second front cavity and an inside port or a second passive radiator. Then, the low-frequency sound re-radiates through surfaces of the enclosure and possible leaks in the enclosure to the outside environment. The low-frequency output is boosted.

15 Claims, 3 Drawing Sheets

ELECTRONIC DEVICE WITH LOUDSPEAKER MODULE

FIELD OF THE INVENTION

The present disclosure relates to the field of electroacoustic transducers, and in particular, to an electronic device with a loudspeaker module.

BACKGROUND

In conventional loudspeaker modules for portable devices such as phones, tablets/PADs and so on, the back cavity of the module is usually sealed to prevent sound from radiating to the interior space of the portable device from the rear side of the loudspeaker module. However, it is difficult to achieve a high efficiency and good extended low-frequency response in a very small enclosure due to fundamental theoretical limits of the portable devices.

Therefore, it is desired to provide an improved loudspeaker module for portable electronic devices.

SUMMARY

In one aspect, the present disclosure provides an electronic device which comprises an enclosure defining a chamber and a first output port communicating the chamber with outside of the enclosure; and a loudspeaker module disposed within the chamber. The loudspeaker module comprises a first front cavity in communication with the first output port, a second front cavity, a rear cavity, a transducer disposed between the first front cavity and the rear cavity, and a first passive radiator disposed between the second front cavity and the rear cavity. The second front cavity is acoustically connected to the outside of the enclosure or an inside space of the enclosure such that the first passive radiator is capable of radiating low-frequency sound to the outside of the enclosure or the inside space of the enclosure via the second front cavity.

In some embodiments, the enclosure further comprises a second output port communicating the second front cavity with the outside of the enclosure such that the first passive radiator is capable of radiating low-frequency sound to the outside of the enclosure via the second front cavity and the second output port.

In some embodiments, the loudspeaker module further comprises an inside port communicating the second front cavity with the inside space such that the first passive radiator is capable of radiating low-frequency sound to the inside space of the enclosure via the second front cavity and the inside port.

In some embodiments, the enclosure further comprises an extension channel connected to the inside port such that the first passive radiator is capable of radiating low-frequency sound to the inside space of the enclosure via the second front cavity, the inside port and the extension channel.

In some embodiments, the extension channel is formed by a hollow tube, duct or pipe.

In some embodiments, the loudspeaker module further comprises a second passive radiator disposed between the second front cavity and the inside space of the enclosure such that low-frequency sound can be radiated to the inside space of the enclosure by the first passive radiator, the second front cavity and the second passive radiator.

In some embodiments, the first and second passive radiators are vibratable diaphragms which are disposed at opposite sides of the second front cavity respectively.

In some embodiments, the electronic device is portable.

The electronic device may be a mobile phone or a tablet or a PAD.

In some embodiments, the first passive radiator is a vibratable diaphragm.

In another aspect, the present disclosure provides a loudspeaker module which comprises a first front cavity unsealed at a first side of the loudspeaker module, a second front cavity, a rear cavity, a transducer disposed between the first front cavity and the rear cavity, and a first passive radiator disposed between the second front cavity and the rear cavity.

In some embodiments, the second front cavity is unsealed at the first side of the loudspeaker module.

In some embodiments, the second front cavity is unsealed at a second side of the loudspeaker module which is opposite to the first side of the loudspeaker module.

In some embodiments, the first passive radiator is a vibratable diaphragm.

In some embodiments, the loudspeaker module further comprises a second passive radiator, and the first passive radiator and second passive radiators are vibratable diaphragms disposed at opposite sides of second front cavity respectively.

BRIEF DESCRIPTION OF THE DRAWINGS

In order to explain the technical solutions of the embodiments of the present disclosure more clearly, accompanying drawings used to describe the embodiments are briefly introduced below. It is evident that the drawings in the following description are only concerned with some embodiments of the present disclosure. For those skilled in the art, in a case where no inventive effort is made, other drawings may be obtained based on these drawings.

DESCRIPTION OF THE EMBODIMENTS

Figure 1:
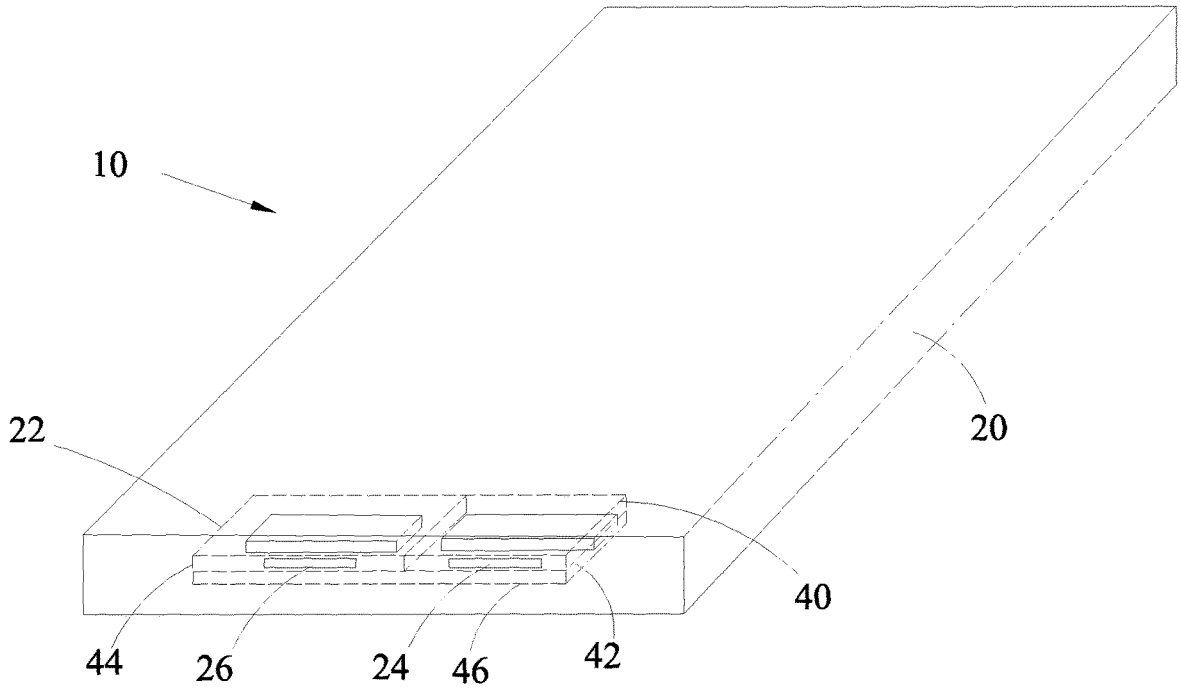
FIG. 1 illustrates an electronic device in accordance with a first embodiment of the present disclosure.

The present disclosure will be further illustrated with reference to the accompanying drawings. It shall be noted that the elements of similar structures or functions are represented by like reference numerals throughout the figures. The embodiments described herein are not intended as an exhaustive illustration or description of various other embodiments or as a limitation on the scope of the claims or the scope of some other embodiments that are apparent to one of ordinary skills in the art in view of the embodiments described in the Application. In addition, an illustrated embodiment need not have all the aspects or advantages shown.

FIG. 1 illustrates an electronic device 10 in accordance with a first embodiment of the present disclosure. In present disclosure, the electronic device 10 is preferably a portable device, such as a mobile phone, a PAD and so on. The electronic device 10 comprises an enclosure 20 and a loudspeaker module 40 disposed within the enclosure 20.

The enclosure 20 defines a chamber 22, a first output port 24 and a second output port 26 connected to outside of the enclosure 20. The loudspeaker module 40 is disposed within the chamber 22.

Figure 2:
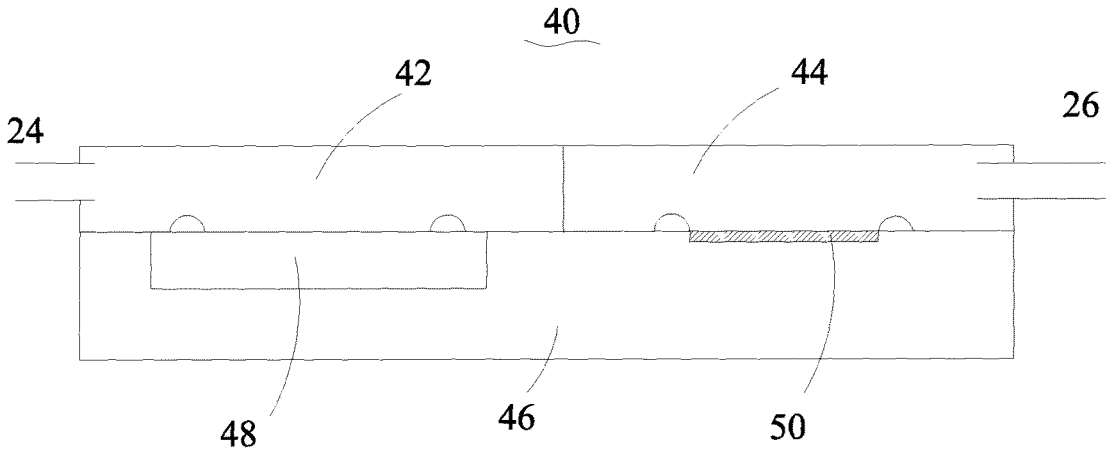
FIG. 2 illustrates a loudspeaker module of the electronic device of FIG. 1.

Referring also to FIG. 2, the loudspeaker module 40 comprises a first front cavity 42 in communication with the outside of the enclosure 20 via the first output port 24, a second front cavity 44 in communication with the outside of the enclosure 20 via the second output port 24, a rear cavity 46, a transducer 48 disposed between the first front cavity 42 and the rear cavity 46, and a first passive radiator 50 disposed between the second front cavity 44 and the rear cavity 46. Specifically, the first and second output ports 24, 26 are located at the front side of the loudspeaker module 40 and respectively connected to the front sides of the first and second front cavities 42, 44. In this embodiment, the first output port 24 is a high-frequency output port and the second output port 26 is a low-frequency output port. The back sides of the first and second front cavities 42, 44 are sealed. In this embodiment, the front side and back side of the first and second cavities 42, 44 are arranged along the longitudinal direction of the enclosure 20. The front and rear cavities are arranged along the depth direction of the enclosure 20 which is perpendicular to the longitudinal direction of the enclosure 20.

In this embodiment, transducer 48 comprises a vibratable diaphragm 482 for converting an input electrical signal into a corresponding acoustic output signal. The passive radiator 50 may be a diaphragm suspended between the second front cavity 44 and the rear cavity 50. In operation, the vibratable diaphragm 482 powered by electricity vibrates and bounds the first front cavity 42 and the rear cavity 46, which resulting in passively vibrating of the first passive radiator 50. Thus, the first passive radiator 50 is capable of radiating the low-frequency sound directly to outside of the enclosure 20 via the second front cavity 42 and the second output port 24. This approach has been proven experimentally to produce good results.

Figure 3:
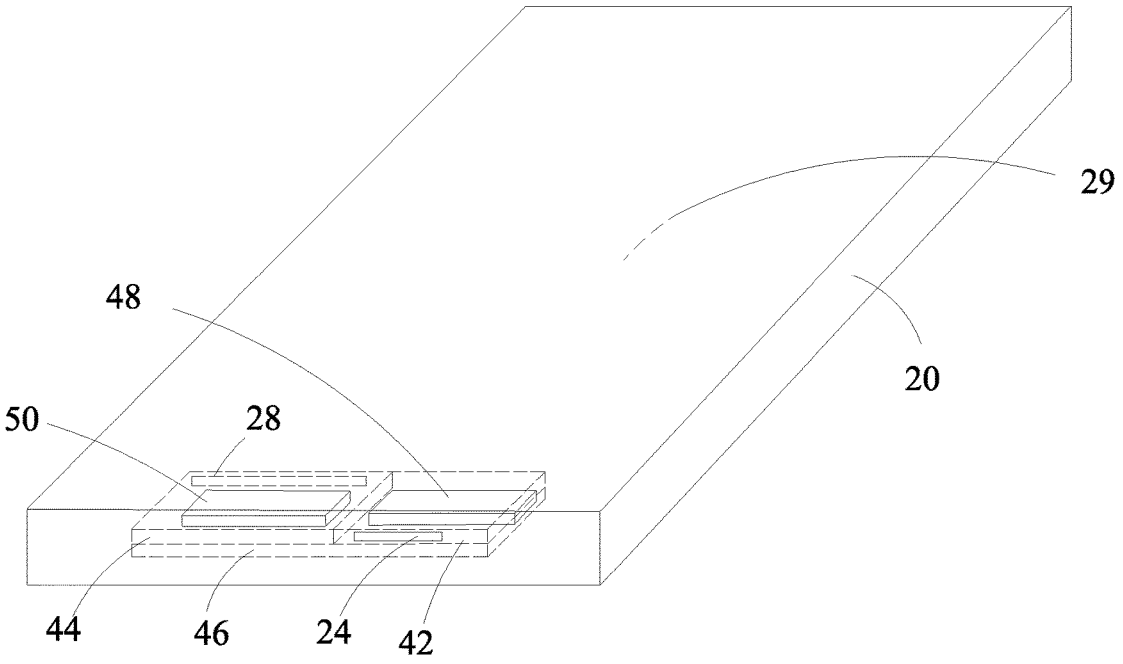
FIG. 3 illustrates an electronic device in accordance with a second embodiment of the present disclosure.
Figure 4:
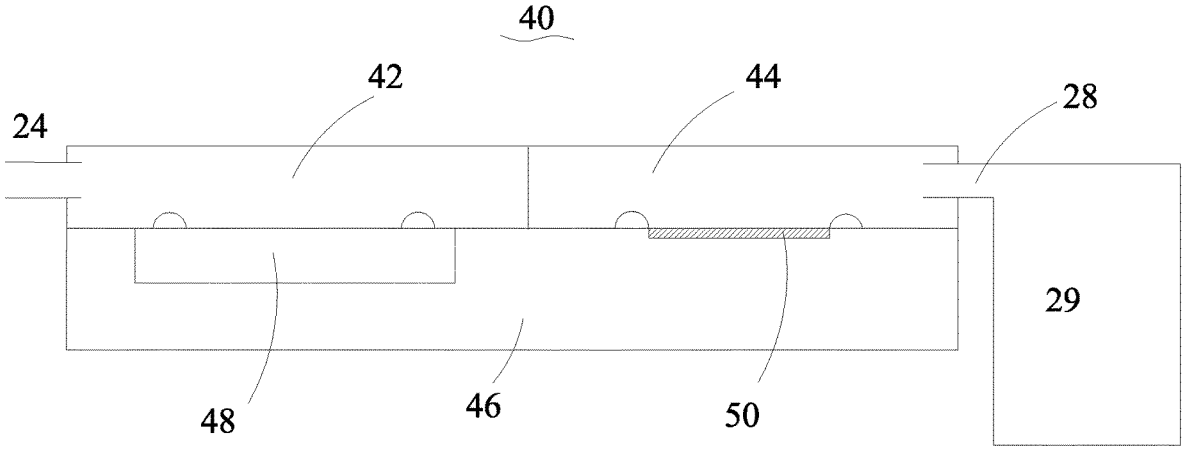
FIG. 4 illustrates a loudspeaker module of the electronic device of FIG. 3.

FIG. 3 illustrates an electronic device 10 in accordance with a second embodiment of the present disclosure. FIG. 4 illustrates a loudspeaker module of the electronic device of FIG. 3. In this embodiment, the enclosure 20 defines only one first output port 24 without a second output port 26 of the first embodiment at the front side of the loudspeaker module 40. The loudspeaker module 40 defines an inside port 28 communicating the second front cavity 44 with the inside space 29 of the enclosure 20 around the chamber 22. Preferably, the inside port 28 is located at the back side of the second front cavity 44. That is, the second front cavity 44 is unsealed at the back side thereof.

In this embodiment, the first passive radiator 50 can radiate the low-frequency sound directly to the inside space 29 of the enclosure 20 via the second front cavity 44 and the inside port 28. Then, the low-frequency sound re-radiates through surfaces of the enclosure 20 and possible leaks in the enclosure 20 to outside of the enclosure 20. The low-frequency output can be excessively attenuated by the enclosure 20. The inside port 28 is added to connect with the second front cavity 44. This added port-cavity combination forms a resonator which serves the following acoustical functions:

boosting the output from the loudspeaker module 40 to the interior air space of the enclosure 20, compensating for the low-frequency acoustical attenuation provided by the enclosure 20;

the acoustical inductance of the port coupled to the passive radiator 50 at low frequencies, enabling a slightly lower physical mass for the passive radiator 50, which is a benefit in the mechanical design;

the displacement requirement of the passive radiator 50 being reduced due to the resonator gain; and the resonator attenuating the higher frequencies propagating to the enclosure 20, which generates the following benefits: the high-frequency sound pressure in the inside space of the enclosure 20 being reduced and so the acoustical feedback to the loudspeaker module 40 being reduced, and as the frequency response of the sound radiated through the enclosure at high frequencies is highly irregular due to the mechanical resonances (both magnitude response and polar pattern), this acoustical filtering of higher frequencies facilitating to create a smoother overall response.

In this embodiment, the acoustical arrangement enables the use of the enclosure 20 of the portable device 10 as a radiating surface for low frequencies radiated through the rear side of the loudspeaker module 40, while the high frequency content is radiated through the output port 24 connected to the front side of the loudspeaker module 40. The sound radiated from the rear side of the loudspeaker module 40 is shaped through the use of at least two acoustical resonators, so that at least one resonator uses a passive radiator 50 to create the desired low-frequency resonance characteristics, which provides more extended low-frequency response than sealed enclosures with a substantially larger acoustical output for a given loudspeaker driver displacement, while removing the need for separate sound ports for low frequencies in the exterior cover. The performance of the embodiment does not decrease if there are acoustical leakages from the interior space/cavity of the enclosure 20 to the outside (the frequency response changes, but leakages can actually boost the output at the lowest frequencies).

Figure 5:
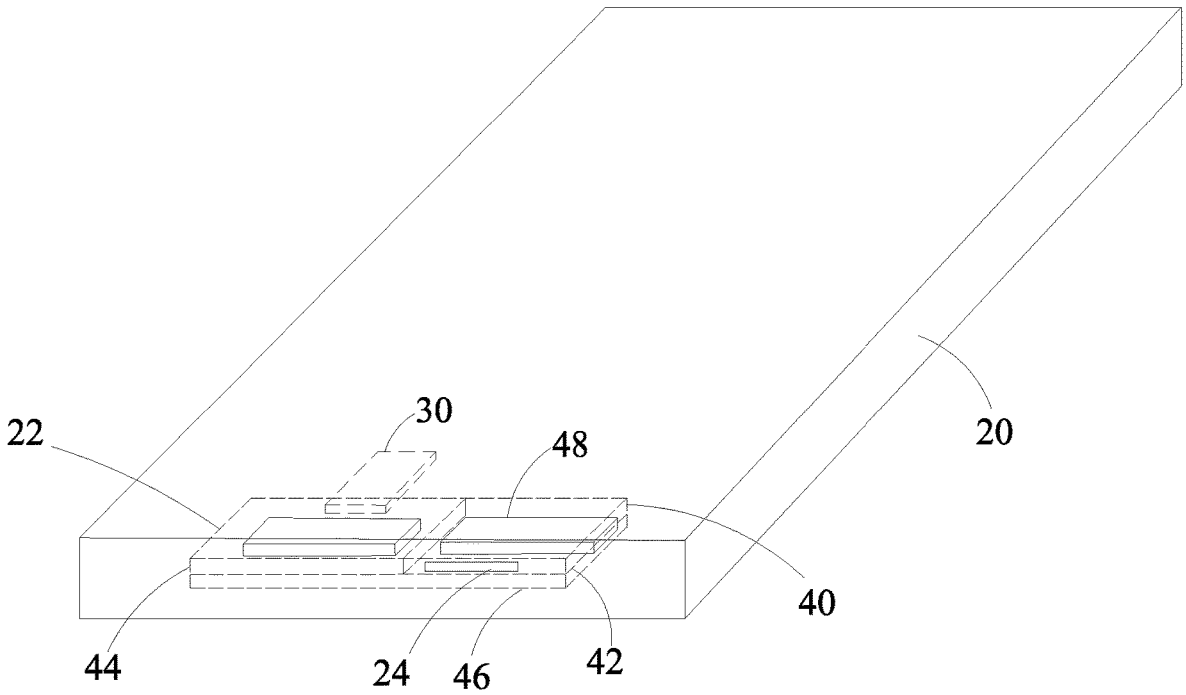
FIG. 5 illustrates an electronic device in accordance with a third embodiment of the present disclosure.

FIG. 5 illustrates an electronic device 10 in accordance with a third embodiment of the present disclosure. In this embodiment, the inside port 28 is connected to an extension channel 30 which is disposed within the inside space 29. The passive radiator 50 can radiate the low-frequency sound to the inside space 29 of the enclosure 20 via the second front cavity 44, the inside port 28 and the extension channel 30. Then, the low-frequency sound re-radiates through surfaces of the enclosure 20 and possible leaks in the enclosure 20 to outside of the enclosure 20. The passive radiator 50, the second front cavity 44, the inside port 28 and the extension channel 30 act as multiple acoustical resonators which are used to boost the low-frequency sound radiating to the interior of the portable device. The extension channel 30 may be formed by a hollow tube/pipe/duct.

Although the above examples show only one passive radiator and one inside port, the use of multiple passive radiators 50 and/or inside ports 28 is a trivial extension of principle. Under the condition that mechanical design constraints allow, the lengths of the multiple ports can be chosen so that the longitudinal resonances are not at the same frequencies, reducing the coloration of the sound, and the locations of the inside ports inside the enclosure can be chosen to reduce the excitation of standing waves inside the enclosures 20. The inside port 28 can take various shapes, such as folded or spiral structures to keep the dimensions of the loudspeaker module sufficiently compact.

Figure 6:
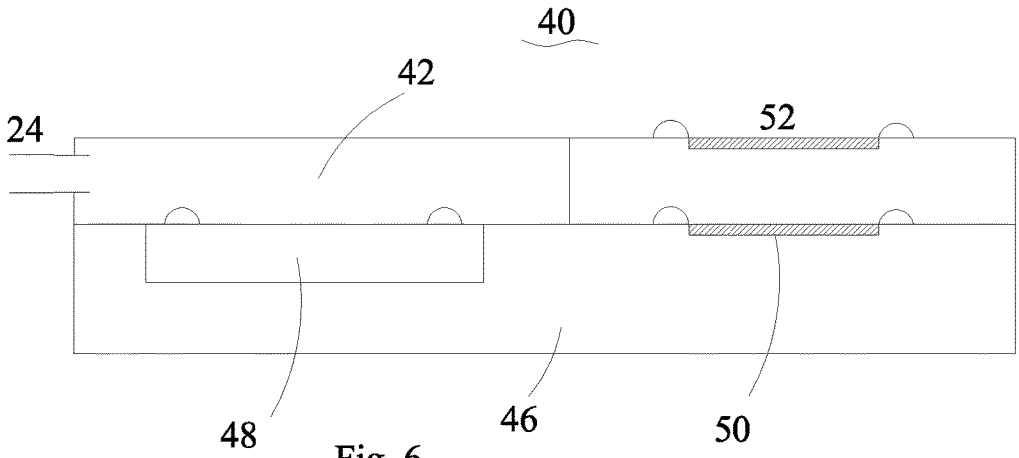
FIG. 6 illustrates a loudspeaker module of the electronic device in accordance with a fourth embodiment of the present disclosure.

FIG. 6 schematically illustrates a loudspeaker module of the electronic device in accordance with another embodiment of the present disclosure. In this embodiment, a second passive radiator 52 is applied to replace the inside port 28 of the above embodiments, which is easier to tune to the desired frequency, and the nonlinearities related to port flow are avoided. On the other hand, implementing the second resonator 52 at the higher tuning frequency is realistic using a port/duct, since the higher tuning frequency would allow realistic port dimensions (short and wide enough), while the first resonator 50 is practical only using a passive radiator due to the required lower tuning frequency.

The above second and third embodiments have the following main advantages:

Increased low-frequency output and reduced displacement as compared to loudspeaker modules sealed at the back side thereof;

No additional output ports being needed for outputting low frequencies;

Low-frequency vibration can be used to enhance haptic effects;

As the displacement for a given low-frequency sound output being reduced as compared to loudspeaker modules sealed at the back side thereof, high-frequency modulation distortion due to diaphragm movement is also reduced.

The combined effect of the boost in the low-frequency output and the significantly reduced displacement implies that the acoustical output that can be achieved from the embodiments of the present disclosure is much larger than what would be achieved from a conventional sealed loudspeaker module in a portable device.

Although the invention is described with reference to one or more embodiments, the above description of the embodiments is used only to enable people skilled in the art to practice or use the invention. It should be appreciated by those skilled in the art that various modifications are possible without departing from the spirit or scope of the present invention. The embodiments illustrated above should not be interpreted as limits to the present invention, and the scope of the invention is to be determined by reference to the claims that follow.

What is claimed is:

1. An electronic device comprising:

an enclosure defining a chamber and a first output port communicating the chamber with outside of the enclosure; and a loudspeaker module disposed within the chamber, the loudspeaker module comprising a first front cavity in communication with the first output port, a second front cavity, a rear cavity, a transducer disposed between the first front cavity and the rear cavity, and a first passive radiator disposed between the second front cavity and the rear cavity;

wherein the second front cavity is acoustically connected to the outside of the enclosure or an inside space of the enclosure such that the first passive radiator is capable of radiating low-frequency sound to the outside of the enclosure or the inside space of the enclosure via the second front cavity.

2. The electronic device of claim 1, wherein the enclosure further comprises a second output port communicating the second front cavity with the outside of the enclosure such that the first passive radiator is capable of radiating low-frequency sound to the outside of the enclosure via the second front cavity and the second output port.

3. The electronic device of claim 1, wherein the loudspeaker further comprises an inside port communicating the second front cavity with the inside space such that the first passive radiator is capable of radiating low-frequency sound to the inside space of the enclosure via the second front cavity and the inside port.

4. The electronic device of claim 3, wherein the enclosure further comprises an extension channel connected to the inside port such that the first passive radiator is capable of radiating low-frequency sound to the inside space of the enclosure via the second front cavity, the inside port and the extension channel.

5. The electronic device of claim 4, wherein the extension channel is formed by a hollow tube/duct/pipe.

6. The electronic device of claim 1, wherein the loudspeaker module further comprises a second passive radiator disposed between the second front cavity and the inside space of the enclosure such that low-frequency sound can be radiated to the inside space of the enclosure by the first passive radiator, the second front cavity and the second passive radiator.

7. The electronic device of claim 6, wherein the first and second passive radiators are vibratable diaphragms which are disposed at opposite sides of the second front cavity respectively.

8. The electronic device of claim 1, wherein the electronic device is portable.

9. The electronic device of claim 1, wherein the electronic device is a mobile phone or a tablet or a PAD.

10. The electronic device of claim 1, wherein the first passive radiator is a vibratable diaphragm.

11. A loudspeaker module comprising a first front cavity unsealed at a first side of the loudspeaker module, a second front cavity, a rear cavity, a transducer disposed between the first front cavity and the rear cavity, and a first passive radiator disposed between the second front cavity and the rear cavity.

12. The loudspeaker module of claim 11, wherein the second front cavity is unsealed at the first side of the loudspeaker module.

13. The loudspeaker module of claim 11, wherein the second front cavity is unsealed at a second side of the loudspeaker module which is opposite to the first side of the loudspeaker module.

14. The loudspeaker module of claim 11, further comprising a second passive radiator, wherein the first passive radiator and second passive radiators are vibratable diaphragms disposed at opposite sides of the second front cavity respectively.

15. The loudspeaker module of claim 11, wherein the first passive radiator is a vibratable diaphragm.

* * * * *